United States Patent [19]

Keeler

[11] Patent Number: 4,626,695

[45] Date of Patent: Dec. 2, 1986

[54] PHOTOELECTRIC COMBUSTION PRODUCTS DETECTOR WITH LOW POWER CONSUMPTION AND IMPROVED NOISE IMMUNITY

[75] Inventor: Manley S. Keeler, Naperville, Ill.

[73] Assignee: Pittway Corporation, Aurora, Ill.

[21] Appl. No.: 631,534

[22] Filed: Jul. 16, 1984

[51] Int. Cl.[4] ..... G08B 17/10

[52] U.S. Cl. ..... 250/574; 340/630

[58] Field of Search ..... 250/573–574; 340/628–630; 356/438–439

[56] References Cited

U.S. PATENT DOCUMENTS

| | | | |
|---|---|---|---|
| 4,025,915 | 5/1977 | Enemark | 340/630 |
| 4,481,506 | 11/1984 | Honma | 340/630 |
| 4,511,889 | 4/1985 | Atwater | 340/629 |

*Primary Examiner*—Edward P. Westin

*Attorney, Agent, or Firm*—Emrich & Dithmar

[57] ABSTRACT

A photoelectric combustion products detector for periodically sampling the ambient air includes a sampling circuit capacitively coupled to an AC source, so that the coupling capacitor produces at the sampling circuit a source current 90° out of phase with the AC source voltage, which is rectified to provide a supply voltage. Sampling is controlled by a NAND gate having at its inputs a varying threshold level which is proportional to and in phase with the supply voltage. A ramp signal generator connected to one gate input terminal enables the gate when the ramp signal exceeds the varying threshold level. The other input terminal of the gate is connected to a timing circuit comprising a Zener diode, a capacitor and a discharge resistor which produces a short trigger pulse at or near each positive zero crossing of the AC source voltage, the coincidence of a trigger pulse with an enabling period causing the gate to actuate the sampling circuit.

20 Claims, 2 Drawing Figures

20
V+
85
86
Z
Y
X
70
60
80
40
56

PHOTOELECTRIC COMBUSTION PRODUCTS DETECTOR WITH LOW POWER CONSUMPTION AND IMPROVED NOISE IMMUNITY

BACKGROUND OF THE INVENTION

The present invention relates to combustion products detectors, and particularly to such detectors of the type which periodically sample the ambient air for the presence of combustion products. The invention has particular application to combustion products detectors of the photoelectric type.

Combustion products detectors for detecting smoke or other particulate airborne combustion products are generally of two types, viz., the ionization type and the photoelectric type. In the photoelectric-type detector, a light source illuminates a darkened chamber into which ambient air is admitted. Combustion products scatter the light to a photoelectric sensor which produces a signal indicative of the presence of the combustion products. Commonly, such detectors actuate the light source periodically, the sampling period preferably being rather long so as to minimize power consumption.

Some such detectors are designed for operation from an AC power source. But there is a large amount of electrical noise present on any commercial AC power line which tends to disrupt the normal operation of the smoke detecting circuits. Thus, it is necessary to eliminate most of this noise. Since this noise is at a maximum during the peaks of the AC line voltage and is at a minimum at the line zero crossings, it is known to so arrange the sampling circuit that the sampling occurs only at or very near the zero crossings of the AC line voltage. Such circuits have, heretofore, been resistively coupled to the AC line.

It is desirable to capacitively couple the sampling circuitry to the AC supply to further minimize power consumption. Such capacitive coupling can reduce power consumption by causing the supply current drawn from the AC line to be almost 90° out of phase with the AC line voltage, thereby significantly improving the power factor. However, prior periodic sampling circuits which sample at the zero crossings are incompatible with capacitive coupling, because the phase difference between the power line voltage and current adversely affects the operation of the zero crossing circuitry.

SUMMARY OF THE INVENTION

It is a general object of the present invention to provide an improved combustion products detector of the periodic sampling type which avoids the disadvantages of prior detectors while affording additional structural and operating advantages.

An important object of the invention is the provision of an AC-powered sampling-type combustion products detector which affords minimum power consumption while at the same time providing improved noise immunity.

In connection with the foregoing object, it is another object of this invention to provide a combustion products detector of the type set forth which includes a zero crossing circuit which can be capacitively coupled to the AC line.

These and other objects of the invention are attained by providing in an AC-powered combustion products detector including sampling means for periodically producing a test signal for testing the ambient air for combustion products, the improvement comprising: capacitive means for coupling the sampling means to an associated source of AC voltage and providing a source current which is substantially 90° out of phase with the AC source voltage, rectifying means coupled to said capacitive means for providing a supply voltage, first control means coupled to the sampling means and responsive to the supply voltage for establishing a predetermined enabling period during which the sampling period between test signals will terminate, and second control means coupled to the sampling means and to the AC source voltage for terminating the sampling period and actuating the sampling means to produce the test signal only at a time during the enabling period when the AC source voltage is at or very near zero.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
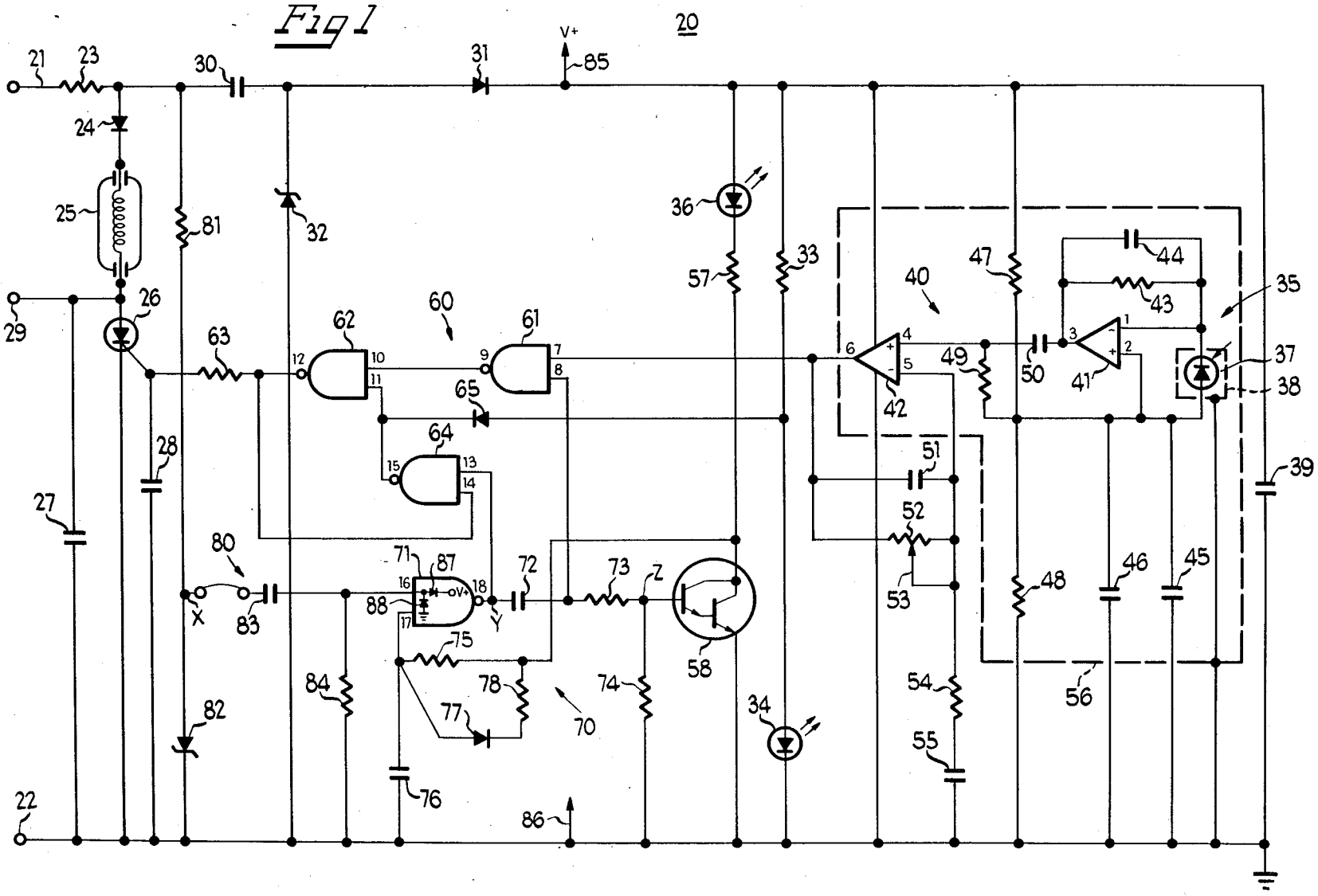
FIG. 1 is a schematic circuit diagram of the combustion products detector of the present invention.

Referring to FIG. 1 of the drawings, there is illustrated a detector circuit 20 of the photoelectric type, constructed in accordance with and embodying the features of the present invention. The detector circuit 20 is adapted to be connected by conductors 21 and 22 to the high and neutral terminals of an associated 120 VAC supply. Connected in series across the AC supply are a resistor 23, a diode 24, a horn 25 and an SCR 26. A capacitor 27 is connected in parallel with the SCR 26 and a capacitor 28 is connected between the gate terminal of the SCR 26 and the neutral conductor 22 which is at ground. The anode of the SCR 26 is connected to an interconnect terminal 29 adapted for interconnection of the detector circuit 20 with other like detector circuits in a network.

A coupling capacitor 30 has one terminal thereof connected to the anode of the diode 24 and the other terminal thereof connected to the anode of a diode 31. The junction between the capacitor 30 and the diode 31 is connected to the cathode of a Zener diode 32, the anode of which is connected to the neutral conductor 22. The capacitor 30 has an impedance at 60 Hz which is high in comparison to the impedance of the rest of the detector circuit 20. Connected in series between the cathode of the diode 31 and ground are a resistor 33 and an LED 34 of the type which emits visible light.

The detector circuit 20 includes a photoelectric sensor circuit, generally designated by the numeral 35, which includes an infrared LED 36 having its anode connected to the cathode of the diode 31. The sensor circuit 35 also includes a photodiode 37 disposed within a grounded metal shield 38. A filter capacitor 39 is connected between the anode of the LED 36 and ground. The sensor circuit 35 also includes an integrated circuit amplifier 40, which has first and second operational amplifier stages 41 and 42, and may be an LM 358A integrated circuit. The photodiode 37 is connected across the input terminals 1 and 2 of the amplifier stage 41. The gain of the amplifier stage 41 is set by a resistor 43 and a capacitor 44 connected in parallel between the input terminal 1 and the output terminal 3 of the amplifier stage 41. Connected in parallel between the input terminal 2 of the amplifier stage 41 and ground are filter capacitors 45 and 46.

The diode 31 provides a rectified supply voltage for the integrated circuits in the detector circuit 20, as will be explained more fully below, the cathode of the diode 31 being connected to an IC supply terminal 85 and the neutral conductor 22 being connected to an IC supply terminal 86. Connected in series across the IC supply are resistors 47 and 48 which comprise a voltage divider, the junction between the resistors 47 and 48 being connected to the input terminal 2 of the amplifier stage 41 to establish an operating point therefor. That operating point is also applied via a resistor 49 to the input terminal 4 of the amplifier stage 42, which input terminal is connected by a capacitor 50 to the output terminal 3 of the amplifier stage 41.

Connected in parallel between the other input terminal 5 of the amplifier stage 42 and its output terminal 6 are a capacitor 51 and a potentiometer 52 having a wiper terminal 53, for providing a variable gain for the amplifier stage 42. Connected in series between the input terminal 5 of the amplifier stage 42 and ground are a resistor 54 and a capacitor 55. Preferably, the amplifier integrated circuit 40 and the photodiode 37 and associated elements, with the exception of the LED 36, are all contained within a grounded metal shield 56. The cathode of the infrared LED 36 is connected by a resistor 57 to the collector of a Darlington transistor 58, the emitter of which is grounded.

The output of the sensor circuit 35 is coupled to a latch circuit, generally designated by the numeral 60, which also comprises an integrated circuit, which may be a CD 4093BE integrated circuit. More particularly, the latch circuit 60 includes a NAND gate 61 having one input terminal 7 connected to the output terminal 6 of the amplifier stage 42, and having an output terminal 9 connected to one input terminal 10 of a NAND gate 62. The output terminal 12 of the NAND gate 62 is connected through a resistor 63 to the control terminal of the SCR 26. The output terminal 12 of the NAND gate 62 is also connected to the input terminal 14 of a NAND gate 64, the output terminal 15 of which is connected to the other input terminal 11 of the NAND gate 62. The input terminal 11 is also connected to the cathode of a diode 65, the anode of which is connected to the junction between the resistor 33 and the LED 34.

Actuation of the infrared LED 36 is controlled by a timing control circuit, generally designated by the numeral 70, which includes a NAND gate 71 which is a part of the integrated circuit of the latch circuit 60. The output terminal 18 of the NAND gate 71 is connected to the other input terminal 13 of the NAND gate 64, and is also connected through a capacitor 72 and a resistor 73 to the base of the Darlington transistor 58. The junction between the capacitor 72 and the resistor 73 is connected to the other input terminal 8 of the NAND gate 61. A resistor 74 is connected between the base of the Darlington transistor 58 and ground. One input terminal 17 of the NAND gate 71 is connected through a resistor 75 to the collector of the Darlington transistor 58 and through a capacitor 76 to ground. Connected in parallel with the resistor 75 are a series-connected diode 77 and resistor 78.

Coupled to the timing control circuit 70 is a trigger circuit, generally designated by the numeral 80, which includes a resistor 81 connected between the junction of the resistor 23 and the coupling capacitor 30 and the anode of a Zener diode 82, the cathode of which is connected to ground. The junction between the resistor 81 and the Zener diode 82 is connected to one terminal of a capacitor 83, the other terminal of which is connected to the other input terminal 16 of the NAND gate 71. Terminal 16 is also connected through a resistor 84 to ground. Terminal 16 is also connected, internally of the IC NAND gate 71, to the anode of a diode 87, the cathode of which is connected to V+ supply and to the cathode of the diode 88, the anode of which is grounded.

Figure 2:
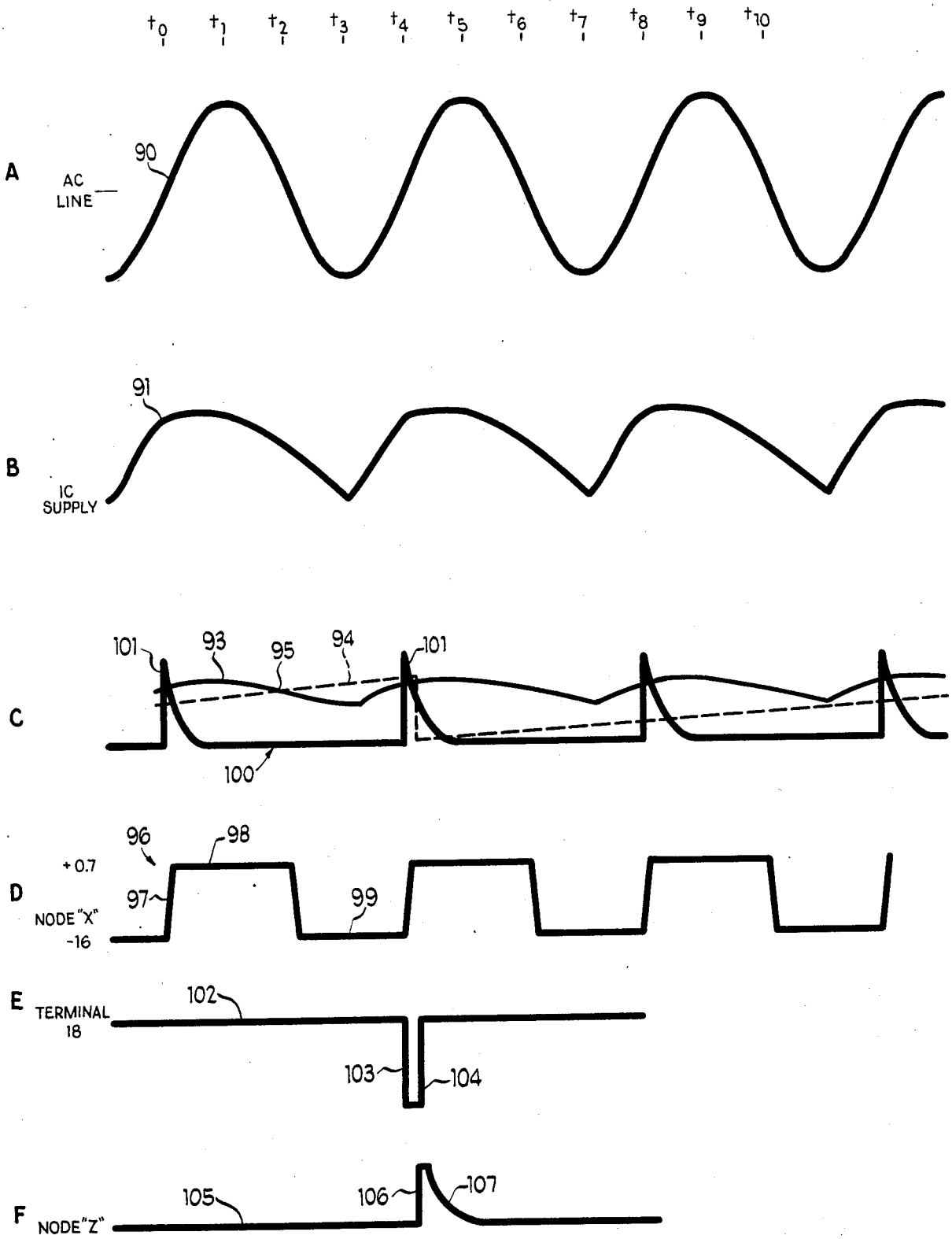
FIGS. 2A–F are waveform diagrams of signals taken are various points in the circuitry of FIG. 1.

Referring now also to FIG. 2 of the drawings, the operation of the detector circuit 20 will be described. In use, the infrared LED 36 and the photodiode 37 are both disposed in a photochamber, from which ambient light is preferably excluded, in a well known manner. When a pulse of current is driven through the infrared LED 36, it produces a flash of infrared light inside the photochamber. The photochamber is constructed so that there is no direct light path between the LED 36 and the photodiode 37. However, if smoke is in the chamber, then a portion of the light emitted by the LED 36 is reflected by the smoke into the photodiode 37, which in turn emits a current pulse which is proportional to the smoke density in the chamber. This current pulse is amplified and converted to a voltage pulse by the amplifier 40 and, if it is sufficiently large, it will trigger the latch circuit 60 to drive the SCR 26 into conduction and sound the horn 25, until such time as an amplifier pulse occurs which is too small to set the latch circuit 60. When such a small pulse occurs, the latch circuit 60 is reset to the OFF state, silencing the horn 25.

The LED 36 is periodically energized at a predetermined sampling rate. Preferably, the sampling period, i.e., the time between LED pulses, is relatively long, preferably about three seconds, in order to minimize the power consumption of the detector circuit 20. The general operation described above is common in known photoelectric-type combustion products detector circuits.

It is desirable to make the sampling pulses occur when the AC line voltage is at or very near zero, in order to minimize electrical noise impact on the detector circuit 20. This technique is used, for example, in the BRK Model 2769 smoke detector, sold by Pittway Corporation. The detector circuit in that product is resistively coupled to the AC supply. However, this resistive coupling does not provide optimum power consumption. It is known that a capacitively coupled detector circuit can dissipate less power than a resistively coupled circuit. Such capacitive coupling is used, for example, in the BRK Model 1769 smoke detector, sold by Pittway Corporation. However, this capacitive coupling cannot be simply substituted in the Model 2769 detector, since it prevents the sampling pulses from occurring at or near the zero crossings of the line voltage, thereby adversely affecting the noise suppression characteristics of the circuit.

The present invention solves this difficulty. The 120 VAC voltage is applied across the terminals 21 and 22, the resistor 23 serving to minimize the effect of surges and transients on the input voltage, but being of sufficiently small resistance that its power dissipation is negligible. The AC voltage is coupled through the capacitor 30 to the rectifying diode 31. Because of the relatively large impedance of the capacitor 30, the current drawn by the capacitor 30 is substantially 90° out of phase with the AC line voltage, with the result that the capacitor 30 dissipates substantially zero watts. The AC line voltage is illustrated in the waveform 90 of FIG. 2A. The voltage at the anode of the diode 31 is clamped by the Zener diode 32 to approximately 12.0 volts, and is rectified by the diode 31 to provide at the terminal 85 a DC supply voltage for the integrated circuits. The waveform 91 in FIG. 2B illustrates (in exaggerated form) the AC ripple which is a small part of the DC supply voltage. It will be appreciated that this supply voltage is applied to the integrated circuits of the amplifier 40 and the latch circuit 60 via the terminals 85 and 86. This supply voltage normally energizes the LED 34 through the resistor 33, the LED 34 serving to provide a visible indication that the power supply is operative and that the detector circuit 20 is in its standby condition, i.e., it is not detecting combustion products.

The periodic actuation of the infrared LED 36 of the sensor circuit 35 is controlled by the timing control circuit 70. Normally, the output terminal 18 of the NAND gate 71 is high, as indicated by the voltage level 102 in the waveform of FIG. 2E. The base of the Darlington transistor 58, designated node "Z", is held low by the resistor 74, as indicated by the voltage level 105 in the waveform of FIG. 2F, holding the transistor 58 non-conductive. The resistor 57 has a very low resistance, such as about 10 ohms, so that the collector of the transistor 58 is very near the IC supply voltage 91 of FIG. 2B. This voltage at the collector of the transistor 58 charges the capacitor 76 through the resistor 75, producing at the input terminal 17 of the NAND gate 71 a rising ramp voltage waveform 94, illustrated in broken line in FIG. 2C. It should be noted that the curves in the waveforms of FIGS. 2A–F are not all to the same voltage scale. Thus, the slope of the ramp waveform 94 has been exaggerated, for purposes of illustration, and is in fact much shallower than illustrated, the charging of the capacitor 76 preferably occurring over about three seconds and, therefore, requiring many cycles of the AC line voltage 90.

The integrated latch circuit 60 is characterized by the fact that the gate 71 has established an internal threshold voltage level with respect to each of its input terminals 16 and 17, which threshold voltage is a fixed percentage of the IC supply voltage 91. Thus, since the IC supply voltage 91 is not a pure DC but rather has a ripple component, the threshold voltage at the input terminals 16 and 17 of the gate 71 varies proportional to and in phase with the IC supply voltage 91, as illustrated by the waveform 93 in FIG. 2C.

While the capacitor 76 is charging, the trigger circuit 80 periodically applies a trigger voltage pulse to the input terminal 16 of the NAND gate 71. More specifically, the voltage at the junction between the resistor 81 and the Zener diode 82, designated node "X", is illustrated by the waveform 96 in FIG. 2D. The Zener diode 82 has a forward voltage drop of about +0.7 volts and a reverse breakdown voltage of about −16 volts. Thus, when the AC line voltage 90 is below −16 volts, the Zener diode 82 is in reverse conduction, as illustrated by a portion 99 of the waveform 96 in FIG. 2D. But as the AC line voltage rises above −16 volts, the Zener diode 82 ceases its reverse conduction and becomes an open circuit. Thus, the voltage at the node "X", follows the AC line voltage, as indicated at 97 in FIG. 2D, until the voltage at node "X" reaches +0.7 volts, which is substantially ground for purposes of this discussion, at which time the Zener diode 82 begins forward conduction and clamps its anode at +0.7 volts, as indicated by the portion 98 of the waveform in FIG. 2D. This occurs at substantially time $t_o$, which is a positive zero crossing of the AC line voltage 90.

While node "X" is at −16 volts, during the negative half cycle of the AC line voltage 90, the input terminal 16 of the NAND gate 71 is being held at ground by the internal diode 88. When the voltage of node "X" begins rising from −16 volts to +0.7 volts, the other terminal of the capacitor 83, connected to the NAND gate 71, also begins rising at the same rate, but it starts from zero and rises to V+ where it is clamped by the internal diode 87 of the gate 71. The voltage at the input terminal 16 of the NAND gate 71 is illustrated by the waveform 100 in FIG. 2C. It can be seen that as the voltage at the node "X" rapidly rises from −16 volts to +0.7 volts, the voltage at the input terminal 16 of the gate 71 also rapidly rises, as indicated by the voltage pulse 101. When the voltage at the input terminal 16 stops rising due to forward conduction of the Zener diode 82, the capacitor 83 begins rapidly discharging through the resistor 84, causing exponential decay of the voltage pulse 101 at the input terminal 16 of the NAND gate 71.

When the AC line voltage goes through its negative zero crossing at time $t_2$, the voltage at node "X" passes down through +0.7 volts and the Zener diode 82 ceases its forward conduction. The voltage at node "X" then follows the AC line voltage 90 until it passes below −16 volts, at which time the Zener diode 82 again begins reverse conduction, as indicated at 99 in FIG. 2D.

Thus, it will be appreciated that at or very near each positive zero crossing of the AC line voltage 90, a voltage trigger pulse 101 will occur at the input terminal 16 of the NAND gate 71 which is greater than the maximum value of the threshold voltage 93 of terminal 16, causing terminal 16 to go high for a predetermined short period of time (preferably no more than about 20° of an AC line cycle) until the voltage pulse 101 decays back down below the threshold voltage level. Eventually, the ramp voltage 94 at the input terminal 17 of the NAND gate 71 will rise above the threshold voltage 93, as indicated at point 95 in FIG. 2C. This crossover point could occur at any point in the cycle of the AC line voltage 90. At this point, the input terminal 17 of the NAND gate 71 goes high, and will remain high until the threshold voltage 93 again passes above the ramp voltage 94. The threshold voltage 93 of input terminal 17 of the NAND gate 71 may alternate high and low over several cycles of the AC line voltage 90, until the ramp voltage 94 rises above the maximum level of the threshold voltage 93.

As was explained above, this threshold voltage is in phase with the IC supply voltage 91, which is 90° out of phase with the AC line voltage 90. Thus, as can be seen from FIGS. 2A and B, the threshold voltage 93 will peak at or near the positive zero crossings of the AC line voltage 90. Since the trigger circuit 80 prevents the input terminal 16 of the NAND gate 71 from going high except at or near the positive zero crossings of the AC line voltage 90, it will be appreciated that the time when the NAND gate 71 is closed, i.e., when both of its input terminals 16 and 17 are high, can occur only at or near one of these positive zero crossings of the AC line voltage 90, as illustrated at time $t_4$ in FIG. 2C.

When the NAND gate 71 closes, its output terminal 18 goes low, as indicated at 103 in FIG. 2E. When the input terminal 16 of the NAND gate 71 decays back below the threshold 93, a short time after $t_4$, the output terminal 18 of the gate 71 goes back high, as indicated at 104 in FIG. 2E. This upward voltage is coupled through the capacitor 72 and the resistor 73 to the base of the transistor 58, as indicated at 106 in FIG. 2F, turning it on to energize the infrared LED 36. This "on" period of the transistor 58 continues until the capacitor 72 discharges through resistors 73 and 74 and the base-emitter junction of the transistor 58, as indicated at 107 in FIG. 2F. Thus, it will be appreciated that the sampling pulse which turns on the LED 36 will occur approximately once every three seconds, will occur only at or about the time when the AC line voltage is going positive through zero, and will last for only a small portion of an AC line cycle.

When the transistor 58 is conductive, the capacitor 76 rapidly discharges through the diode 77, the resistor 78 and the collector-emitter junction of the transistor 58. This discharging will stop when the transistor 58 is shut off. In the preferred embodiment of the invention, at this time the capacitor 76 will have dropped to a voltage of approximately 5.5 volts.

It will be appreciated that the output of the latch circuit 60, i.e., the output terminal 12 of the gate 62, is normally low, holding the SCR 26 non-conductive. This is because the output terminals 9 and 15 of the gates 61 and 64, respectively, are both held high, the former by the low at the terminal 6 of the amplifier stage 42 and the low at the base of the transistor 58, and the latter by the low at its input terminal 14 which is fed back from the output of the latch circuit 60. If no smoke is present, this situation will not change when the infrared LED 36 is energized, because no light therefrom will be reflected to the photodiode 37.

When smoke is present in a sufficient amount, the reflected light from the pulsed LED 36 will generate an output pulse from the photodiode 37, which is amplified by the amplifier 40, causing its output terminal 6 to go high. This high is applied to the input terminal 7 of the NAND gate 61, the input terminal 8 of which is already high as a result of the return to high of the output terminal 18 of the NAND gate 71 (see FIG. 2E, 104). Thus, the output terminal 9 of the NAND gate 61 goes low, causing the output terminal 12 of the NAND gate 62 to go high, thereby rendering the SCR 26 conductive to sound the horn 25. The high at the output terminal 12 of the NAND gate 62 is fed back to the input terminal 14 of the NAND gate 64, the input terminal 13 of which is already high, causing the output terminal 15 of the gate 64 to go low, thereby latching the output terminal 12 of the gate 62 to high. In the meantime, when the light pulse of the from the LED 36 is terminated, the output of the amplifier will return low, causing the output of the NAND gate 61 to go back high.

When the output terminal 15 of the NAND gate 64 is latched low, it shunts current through the diode 65, thereby turning off the LED 34. This is significant in the event that the detector circuit 20 is connected in a network with other like detector circuits. In such a case, the circuits are typically designed so that the horn 25 will sound if any one of the detector circuits 20 in the network detects smoke. It can be determined which detector circuit 20 has caused the alarm by detecting smoke, by checking to see which LED 34 is extinguished.

At the next sampling, when the NAND gate 71 is closed to pulse the LED 36, the output terminal 18 will go low, causing the output terminal 15 of the gate 64 to go high. This will cause the output terminal 12 of the latch 60 to go low, momentarily turning off horn 25, but almost immediately terminal 18 will go back high and the LED 36 will be pulsed, causing the photodiode 37 to produce another output voltage pulse which will again relatch the latch circuit 60 high. The time that the horn 25 is off, typically only about 1 millisecond, is so short as to be unnoticeable by a listener. When the smoke has cleared, the next time the LED 36 is sampled the output of the amplifier 40 will remain low and the horn 25 will be shut off.

Preferably, the second stage 42 of the amplifier 40 is a band-pass amplifier having a narrow pass band, the low-frequency roll-off point being determined by the resistor 54 and the capacitor 55. The capacitors 44 and 51 serve wave shaping functions in the stages 41 and 42 of the amplifier 40.

The capacitors 27 and 28 serve as noise suppressors to prevent transients from turning on the SCR 26. The capacitor 39 serves as a power supply filter. The metallic shields 38 and 56 around the photodiode 37 and the amplifier circuit 40 serve to protect those components from airborne radiation and electromagnetic fields.

From the foregoing, it can be seen that there has been provided an improved combustion products detector circuit which is capacitively coupled to an AC supply voltage for minimum power consumption and which, at the same time, permits periodic sampling of a photoelectric sensor circuit with the sampling pulses occurring at or very near the zero crossings of the AC line voltage to optimize noise suppression.

I claim:

1. In an AC-powered combustion products detector including sampling means for periodically producing a test signal for testing the ambient air for combustion products, the improvement comprising: capacitive means for coupling the sampling means to an assoicated source of AC voltage and providing a supply current which is substantially 90° out of phase with the AC source voltage, rectifying means coupled to said capacitive means for providing a source voltage, first control means coupled to the sampling means and responsive to said supply voltage for establishing a predetermined enabling period during which the sampling period between test signals will terminate, and second control means coupled to the sampling means and to the AC source voltage for terminating the sampling period and actuating the sampling means to produce the test signal only at a time during said enabling period when the AC source voltage is substantially at zero.

2. The combustion products detector of claim 1, wherein said enabling period includes a plurality of enabling intervals respectively occurring in consecutive cycles of the control voltage.

3. The combustion products detector of claim 2, wherein said enabling intervals are of varying length.

4. The combustion products detector of claim 1, wherein the sampling means includes photoelectric sensing means.

5. The combustion products detector of claim 4, wherein the test signal energizes an LED.

6. The combustion products detector of claim 1, wherein said second control means includes means for terminating the sampling period only substantially at positive zero crossings of the AC source voltage.

7. In an AC-powered combustion products detector including sampling means for periodically producing a test signal for testing the ambient air for combustion products, wherein the sampling frequency is substantially less than the AC frequency, the improvement comprising: capacitive means for coupling the sampling means to an assoicated source of AC voltage and providing a supply current which is substantially 90° out of phase with the AC source voltage, rectifying means coupled to said capcitive means for providing a source voltage, gate means for controlling the actuation of the sampling means, enabling means coupled to said gate means for establishing during each sampling period one or more enabling intervals which respectively occur during portions of consecutive cycles of said supply voltage and for enabling said gate means during each of said enabling intervals, and trigger means coupled to said gate means for triggering said gate means only when the AC source voltage is substantially at zero, said gate means being closed for actuating the sampling means to produce the test signal when said gate means is triggered during an enabling interval.

8. The combustion products detector of claim 7, wherein said enabling means establishes a plurality of enabling intervals of varying length.

9. The combustion products detector of claim 7, wherein said enabling means includes threshold means assoicated with said gate means for establishing a threshold voltage level, said enabling means also including ramp signal generating means producing a rising ramp signal, said enabling intervals occurring when said ramp signal exceeds said threshold voltage level.

10. The combustion products detector of claim 9, wherein said threshold means includes means responsive to the supply voltage for varying said threshold voltage level.

11. The combustion products detector of claim 10, wherein said threshold voltage level is proportional to and in phase with said supply voltage.

12. The combustion products detector of claim 7, wherein said trigger means includes means for triggering said gate means only substantially at the positive zero crossings of the AC source voltage.

13. In an AC-powered combustion products detector including sampling means for periodically producing a test signal for testing the ambient air for combustion products, the improvement comprising: capacitive means for coupling the sampling means to an assoicated source of AC voltage and providing a supply current which is substantially 90° out of phase with the AC source voltage, rectifying means coupled to said capacitive means for providing a source voltage, control means coupled to the sampling means and responsive to said supply voltage for establishing a predetermined enabling period, said control means including trigger means responsive to the rise of the AC source voltage above a predetermined voltage substantially at zero for initiating a trigger pulse and applying it to the sampling means, said trigger means including timing means for limiting the duration of said trigger pulse to a small fraction of a period of the AC source voltage, said control means being responsive to the simultaneous occurrence of a trigger pulse and said enabling period for actuating the sampling means to produce the test signal.

14. The combustion products detector of claim 13, wherein said control means includes means for causing said enabling period to occur repeatedly with a frequency substantially less than the frequency of the AC source voltage.

15. The combustion products detector of claim 14, wherein said control means includes ramp signal generating means for generating a rising ramp signal, and threshold means responsive to said supply voltage for establishing a threshold voltage level which varies proportional to and in phase with said supply voltage, said enabling period comprising enabling intervals occurring during those portions of each of successive cycles of the supply voltage when said ramp signal exceeds said threshold voltage level, said trigger means including means for initiating said trigger pulse substantially at each positive zero crossing of the AC source voltage, and said timing means including means for terminating said trigger pulse no more than substantially 20° of an AC cycle after the initiation of said trigger pulse.

16. The combustion products detector of claim 13, wherein the width of said trigger pulse is no greater than substantially 20° of the AC source voltage cycle.

17. The combustion products detector of claim 13, wherein said timing means is reponsive to continued rise of the AC source voltage through a second voltage level higher than said predetermined voltage for terminating said trigger pulse.

18. The combustion products detector of claim 17, wherein said trigger means includes a Zener diode means connected across the AC source; said timing means including clamping means establishing said second voltage level, a capacitor connected between said clamping means and the anode of said Zener diode, and discharge means connected to the junction between said capacitor and said clamping means for rapidly discharging said capacitor when the voltage at said clamping means reaches said second voltage level.

19. The combustion products detector of claim 13, wherein said sampling means includes a photoelectric sensing means.

20. The combustion products detector of claim 19, wherein said test signal energizes an LED.

* * * * *